US006801730B2

(12) United States Patent
Johnson et al.

(10) Patent No.: US 6,801,730 B2
(45) Date of Patent: Oct. 5, 2004

(54) PRINTER POWER MANAGEMENT

(75) Inventors: Warren Paul Johnson, Emmett, ID (US); Gary Glen Stringham, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 93 days.

(21) Appl. No.: 10/207,047

(22) Filed: Jul. 30, 2002

(65) Prior Publication Data

US 2004/0022553 A1 Feb. 5, 2004

(51) Int. Cl.[7] ..... G03G 21/00
(52) U.S. Cl. ..... 399/75; 399/88
(58) Field of Search ..... 399/75, 76, 77, 399/81, 88; 358/432, 434, 442, 468, 404

(56) References Cited

U.S. PATENT DOCUMENTS 5,086,385 A 2/1992 Launey et al.
5,194,895 A * 3/1993 Bares ..... 399/82
5,640,646 A * 6/1997 Toyohara et al. ..... 399/69
6,128,104 A * 10/2000 Okabe et al. ..... 358/442
6,226,472 B1 5/2001 Yun
6,385,412 B1 * 5/2002 Sadakuni ..... 399/75

FOREIGN PATENT DOCUMENTS

JP 60-54008 * 3/1985
JP 2000-184103 * 6/2000
JP 2002-292973 * 10/2002

* cited by examiner

*Primary Examiner*—Hoan Tran

(57) ABSTRACT

A method for power management of a printer. In the method, a power mode is determined for the printer from one or more calendar entries. In addition, a power save mode is entered into in response a determination that the one or more calendar entries indicates that the printer should enter a power save mode.

27 Claims, 3 Drawing Sheets

PRINTER POWER MANAGEMENT

TECHNICAL FIELD

The present invention relates generally to image producing devices and methods and systems related thereto.

BACKGROUND

Many of the presently available image producing devices typically employ components that consume relatively large amounts of electrical power. For instance, many printers use fusers or fuser assemblies to permanently adhere toner to print media, such as paper. A fuser assembly typically comprises a fuser roller in association with a pressure roller which work together to press the toner onto the print medium. As used herein, the word "print" and the various forms thereof are intended to include printing, copying, and any other form of electrophotographic image production (be it production of an image, text, or otherwise). No limitation is intended by or should be read into use of the word print.

The fuser roller is typically heated to increase the toner's adherence to the print medium. One method of achieving this result is to use toner with some meltable material such as a plastic so that when heated, the toner effectively melts onto and adheres to the print medium. A variety of methods are known to heat the fuser roller, including heating internally using a heating element, such as a fuser lamp.

Typically, the print medium is rolled between a fuser roller and another roller to ensure proper contact between the fuser roller and the print medium. Proper image production requires that the toner and print medium will reach a certain temperature to facilitate proper binding or adherence of the toner to the print medium. Thus, the fuser must operate at a relatively high temperature. The heating elements that warm the fuser use electrical energy, such that keeping the fuser warm whenever the image producing device is turned on but idle may be wasteful.

Other image producing devices may employ devices similar to the fuser described above that operate to help transfer and affix toner to print media. Typically, these devices must be maintained at an elevated temperature during the image production operation. Maintenance of this elevated temperature typically requires a continuous draw of electrical power. The image producing devices described above may also employ other devices which will continuously draw power, such as display devices.

It has generally been known to cause the image producing apparatus to enter a power save mode after a certain period of inactivity. For instance, after a period of about one hour, the image producing apparatus might stop providing electrical power to the heating element for the fuser and allow the fuser to cool down. Depending on the particular device, the warming-up period for the fuser may range from one to several minutes or more. This solution may be unsatisfactory because if a user needs to operate the image producing apparatus at consecutive intervals that are spaced apart, the user may be required to wait a relatively long period of time for the fuser to warm up for each printing operation.

SUMMARY

According to an embodiment, the present invention pertains to a method for power management of a printer. In the method, a power mode is determined for the printer from one or more calendar entries. In addition, a power save mode is entered into in response a determination that the one or more calendar entries indicates that the printer should enter a power save mode.

BRIEF DESCRIPTION OF THE DRAWINGS

Features of certain embodiments of the present invention will become apparent to those skilled in the art from the following description with reference to the drawings, in which.

DETAILED DESCRIPTION

For simplicity and illustrative purposes, the principles of the present invention are described by referring mainly to various embodiments thereof. Although particular embodiments of the invention are disclosed herein, one of ordinary skill in the art will readily recognize that the same principles are equally applicable to, and can be implemented in other systems, and that any such variation would be within such modifications that do not part from the present invention. Before explaining the disclosed embodiments of the present invention in detail, it is to be understood that the invention is not limited in its application to the details of any particular arrangement shown, since the invention is capable of other embodiments. The terminology used herein is for the purpose of description and not of limitation.

Figure 1:
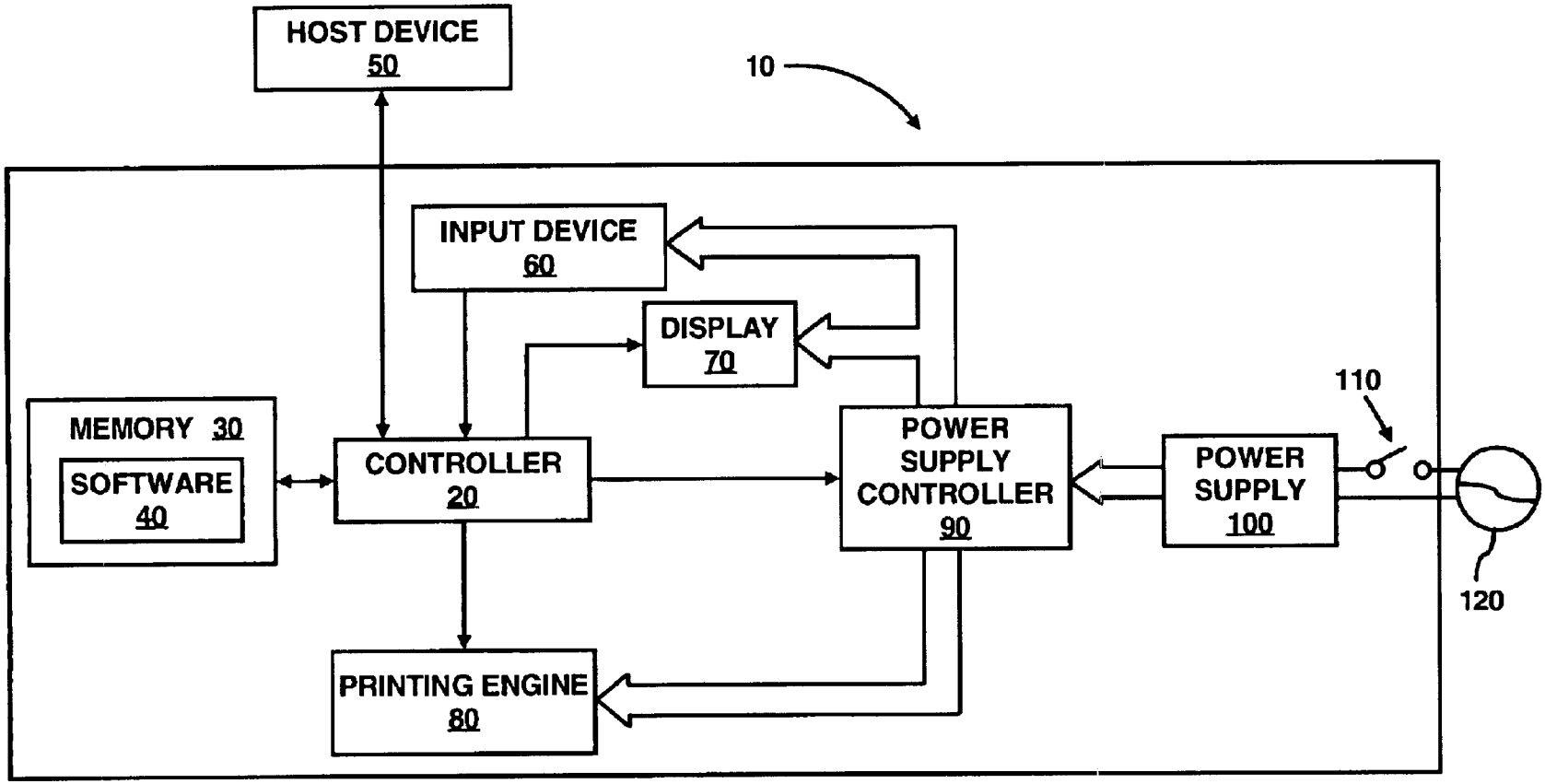
FIG. 1 shows an exemplary block diagram of a system for use in accordance with one embodiment of the present invention.

FIG. 1 shows an exemplary block diagram of a system 10, in this instance an image producing device, for use in accordance with one embodiment of the present invention. The following description of the block diagram illustrates one of a plurality of manners in which the system 10 may operate.

The system 10 includes a controller 20 that may be configured to provide control logic for the system 10. In this respect, the controller 20 may possess a microprocessor, a micro-controller, an application-specific integrated circuit, or the like. The controller 20 may be interfaced with a memory 30 to provide storage of computer software 40 that provides the functionality of the system 10. The memory 30 may also be configured to provide a temporary storage area for data or files received by the system 10 from a host device 50, such as a computer, server, workstation, personal digital assistant, or the like. The memory 30 may be implemented singularly or as a combination of volatile and non-volatile memory, such as dynamic random access memory, EEPROM, flash memory, or the like. It is also within the purview of the present invention that the memory may be included within the host device 50.

The controller 20 may be further interfaced with an I/O interface (not shown) configured to provide a communication between the host device 50, the system 10, and/or internal components within the system 10. The I/O interface (not shown) may conform to protocols such as RS-232, parallel, small computer system interface (SCSI), universal serial bus (USB), transmission control protocol/Internet protocol (TCP/IP), etc. In addition, the controller 20 may be interfaced with an input device 60, a display device 70, a print engine 80, and a power supply controller 90.

Communication between the controller 20 and the host device 50 may be effectuated by wired protocol, such as IEEE 802.3, etc., wireless protocols, such as IEEE 801.11b, wireless serial link, Bluetooth, etc., or combinations thereof.

The controller 20 may include an internal clock (not shown) or may otherwise be configured to track the passage of time. In one embodiment, the controller 20 may retrieve a time stamp from the host device 50 during startup, or otherwise at periodic intervals. The controller 20 may then keep track of the passage of time through use of the internal clock. The controller 20 may also be configured to operate a calendar function, such that a user may download a calendar with a schedule to the controller 20 to the memory 30. The calendar with a schedule may be of the type commonly used by computers to provide a calendar function, by keeping a record of scheduled appointments and other events. The controller 20 may then track both the schedule provided within the calendar, as well as the passage of time (through the controller 20 internal clock).

Using the internal clock and the calendar, the controller 20 may determine when to go in and out of a particular power management mode. For instance, when a meeting is scheduled, or the user is otherwise scheduled to be away from the user's desk or workstation, the system 10 may enter a power save mode, or a form thereof, depending on the anticipated length of the idle time. The total anticipated length of the idle time may be indicated by the calendar. By way of example, a few minutes before the meeting is over, the system 10 may come out of the power management mode so that it can warm up and be ready for operation when the user arrives back to the desk or workstation. As another example, the calendar may indicate the user's expected arrival time each day, so that the system 10 may enter an active mode before the user arrives each day the user will need use of the system 10. In addition, the system 10 may enter a power save mode at a particular time each night the user is expected to not access the system 10. For those days the user is away, such as on a trip or on vacation or otherwise, the system 10 may remain in a power management mode that consumes a relatively small amount of power, such as a standby mode.

The input device 60 may be any reasonable suitable device configured for a user to provide input to the system 10, such as a touch sensitive keypad (not shown) or a voice activated microphone (not shown). The input device 60 may be installed on the outside of the system 10, e.g., on the system 10 housing, so that a user may select various functions provided by the system 10. The input device 60 may output a signal corresponding to a selected function, for input to the system 10. The input device 60 may be configured to operate in a variety of power modes. For instance, the input device 60 may be provided with a power mode selection or otherwise configured such that the input device 60 may operate with a first power mode which is an active mode wherein the input device 60 is maintained at full power so that it is capable of continuous operation.

The input device 60 may also operate in a second power management mode that consumes a relatively small amount of power, such as a standby mode. The input device 60 may operate in a variety of operational modes, in addition to those described above, in response to a signal from the controller 20.

The display device 70 may be any reasonably suitable device configured to display information, such as the operating conditions of the system 10 or user selected inputs received from the input device 60. The display device 70 may be situated on the outside of the system 10 so that a user may review information provided by the display device 70. The display device 70 may receive signals output from the controller 20 and may display the data provided therein for the user's review. The display device 70 may be configured such that the display device 70 may operate within a first power mode which is an active mode wherein the display device 70 is maintained at full power so that it is capable of substantially continuous operation. The display device 70 may also operate within a second power mode, e.g., a power save mode, that may be used when the display device 70 is on standby, such that the display device 70 may use relatively less electrical power than when maintained in the active mode.

In one embodiment, the display device 70 may operate in a plurality of different power management modes. For instance, a light source for the display device 70 may be turned off in one power management mode. In addition, the display device 70 may operate in the desired power management mode in response to a signal from the controller 20.

The print engine 80 performs print jobs for the system 10 at the direction of the controller 20. The print engine 80 may include a variety of motors, belts and/or drums, and a fusing device, as previously described, in addition to a variety of other components used to create images on print media. The print engine 80 may operate in one of a variety of power management modes in response to signals from the controller 20.

A power supply controller 90 may control power supplied from a power supply 100 to the input device 60, the display 70, and the print engine 80, as well as any other components which may operate in either of an active mode and a power save mode, or any other components which make use of electrical power. The power supply 100 may work in conjunction with a power switch 110 which may be used to manually control electrical power to the system 10. The power supply 100 is configured to work in conjunction with electrical power supplied from a power outlet 120, such as a conventional alternating current source of electrical power.

The power supply controller 90 may control power sent to components within the system 10 in accordance with a signal sent to the power supply controller 90 from the controller 20. When the system 10 is in the active mode, a signal may be sent from the controller 20 to the power supply controller 90 with an indication to supply any and/or all of the components within the system 10 with electrical power so that they may operate in accordance with the active mode. When the system 10 is in the power save mode, a signal may be sent from the controller 20 to the power supply controller 90 with an indication to supply any and/or all of the components within the system 10 electrical power so they may operate in the power save mode. The active mode generally consumes more electrical power in comparison with the power save mode. Thus, changes in the power mode of the system 10 may be controlled by the controller 20 through the power supply controller 90. It should be appreciated that an override feature may be provided that would permit a user to select a power mode, regardless of the power mode otherwise indicated by the controller 20. The controller 20 may be configured to signal the power supply controller 90 to change the power mode based on events other than those specified in the calendar, such as receipt of a print job, or an indication that the system should wait to print, or the like.

In another embodiment, the controller 20 may be configured to direct components within the system 10 to operate in any of a variety of power management modes. Thus, power management may be achieved by controlling and varying the operational states of the multiple components within the system 10 independently or jointly. By way of example, the print engine 80 may remain in a fully operable, fully powered-up mode while the display device 70 may operate in a relatively reduced power mode. This may be useful, for instance when the controller 20 determines from the calendar that the system 10 might require operation within a relatively short period of time, given that the print engine 80 may take longer to warm up to a fully operational state as compared to the display device 70. Alternatively, the controller 20 may cause the features or devices that make the components of the system 10 vary in their operational mode. For instance, the print engine 80 may operate in a partial power save mode, idling certain features or devices within the print engine 80, while other features or devices within the print engine 80 may be maintained in a substantially ready state.

According to another embodiment, the controller 20 may be configured to access calendars from multiple users. In this embodiment, a plurality of users may load their calendars into the memory 30 and the system 10 may operate to enter various power modes according to the various user's schedules. Thus, for example, when the calendars indicate that one or more users will require use of the system 10, the system 10 may remain in an active mode.

Figure 2:
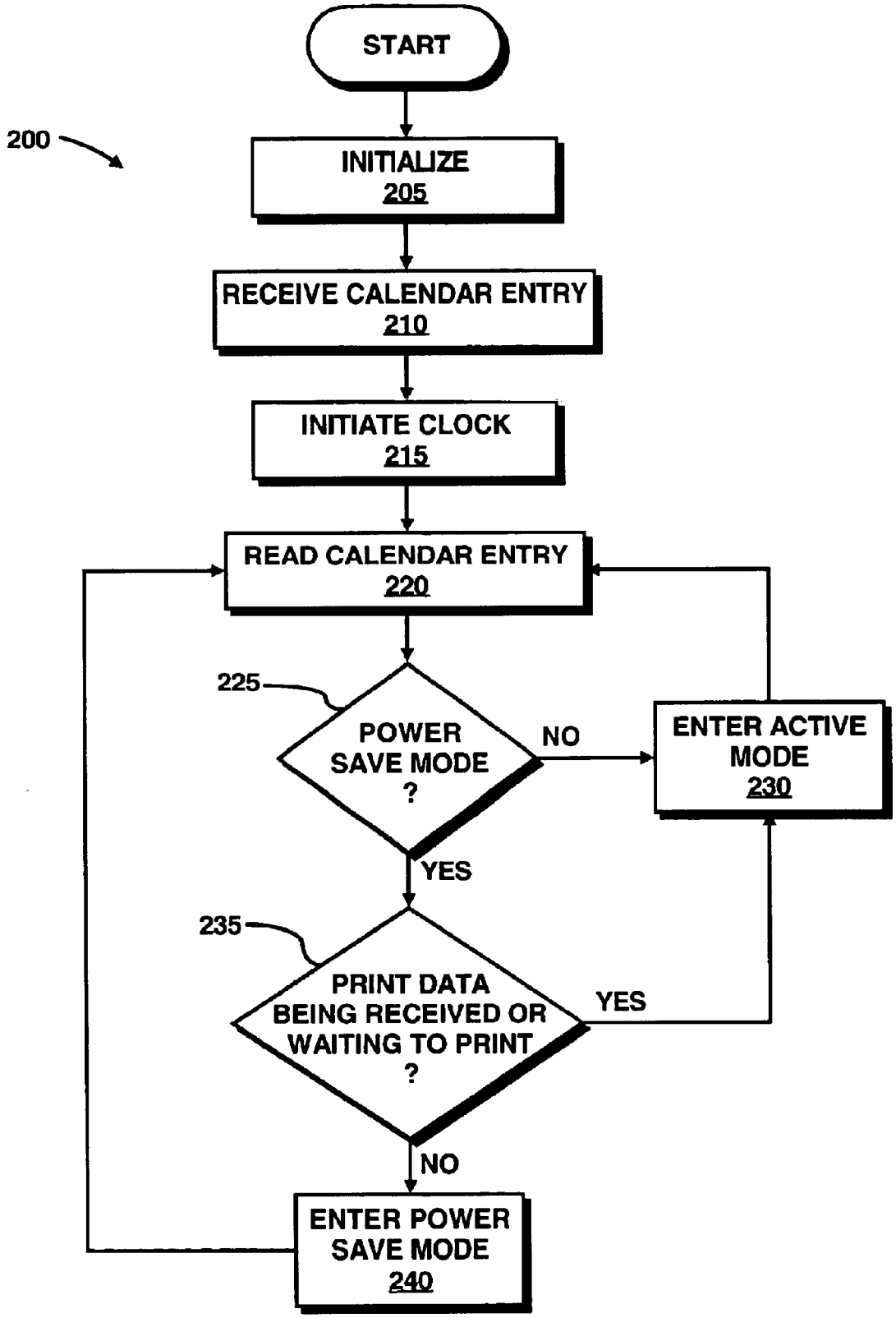
FIG. 2 shows an exemplary flow diagram illustrating a method in accordance with an embodiment of the present invention.

FIG. 2 shows an exemplary flow diagram illustrating a method 200 in accordance with an embodiment of the present invention. In FIG. 2, an initialize step 205 is shown, wherein a printer (e.g., the system 10 illustrated in FIG. 1), or any other device or system for creating images on print media, such as a copier, (hereafter a "printer"), is started by providing power to the printer. In this step, the printer may run its own internal checks, and otherwise begin to ready itself for operation.

At step 210, the printer may receive a calendar from a host device. More specifically, the printer may load scheduled items (e.g., calendar entries) from a calendar in the host device into a memory. The transfer of information from the host device to the printer may be effectuated in much the same manner as is performed for host devices sending files to the printer for printing. For example, host devices may have drivers that format print jobs (for instance into printer job language) and send them to a printer via hardwires, infra-red, or via some other data transmission vehicle. In this regard, the host device may have a driver configured to format the calendar data and send it to the printer and specify, for example, that the calendar data is for a calendar update job to be processed and stored by the printer.

It should be appreciated that the calendar entry receiving step 210 may be performed during the printer initializing step 205.

At step 215, a clock may be initiated which may involve the retrieval of a time stamp from the host device and tracking the passage of time from receipt of the time stamp. The time stamp may be retrieved at periodic intervals to thus substantially maintain an accurate indication of time passage. Alternatively, the printer may be provided with an internal clock configured to run substantially continuously. In this configuration, the internal clock may be configured to operate even when power is not supplied to the printer. Otherwise, the internal clock may be updated when the host device transmits a time stamp to the printer.

At step 220, the printer controller, e.g., controller 20 illustrated in FIG. 1, may access the memory, e.g., memory 30, to read calendar entries. If calendar entries exist, the controller may determine whether the printer should enter into a power save mode at step 225. If the calendar entries indicate that the printer should be operational within a predetermined period of time, the controller may cause the printer to enter into an active mode at step 230. The predetermined period of time may be determined according to a variety of factors, e.g., the next time a user may access the printer, the time until a user's scheduled meeting is to end, and the like. As described hereinabove, the active mode may comprise a plurality of operations, e.g., heating of the fuser roller, lighting of the display device, etc.

At step 230, the controller may also send signals the desired components, such as an input device, a display, and a print engine that they are to operate in active mode. The controller may also send a signal to the power supply controller to operate in active mode, to thus cause the power supply controller to cause electrical power to be delivered to the desired components such that they may operate at relatively full capacity.

At step 225, if the calendar entries indicate that the printer should enter a power save mode, the controller may determine whether print data is being received or the printer is otherwise waiting to print at step 235. The printer may wait to print when the printer, for example, has a file to print that was not completed in an earlier printing operation. If the controller determines that print data is being received or the printer is otherwise waiting to print, the controller may cause the printer to enter into an active mode, as indicated at step 230.

At step 235, if the controller determines that the printer is not receiving print data nor that the printer is otherwise waiting to print, the controller may cause the printer to enter a power save mode at step 240. When the printer is in the power save mode, the printer may draw a relatively small amount of power in comparison to the active mode. In this regard, the printer may decrease the amount of power supplied to the components, e.g., printing engine 80, display device 70, and like components, when the printer is in the power save mode. It should be understood that the amount of reduction in the power supplied to the components may be dependent upon the anticipated amount of time the printer is to remain in the power save mode. By way of example, the power save mode may comprise a greater reduction in the amount of power supplied when the length of time between printer uses is anticipated to be a relatively long period of time.

Following steps 230 and 240, the controller may access the memory to determine whether the printer should alter its power management mode. This process may occur substantially continuously for as long as the printer is operational.

In an alternate embodiment, the printer may switch between a variety of different operating modes based on instructions received by or generated within the printer. At least one of such instructions may include an instruction generated through operation of a calendar function.

Figure 3:
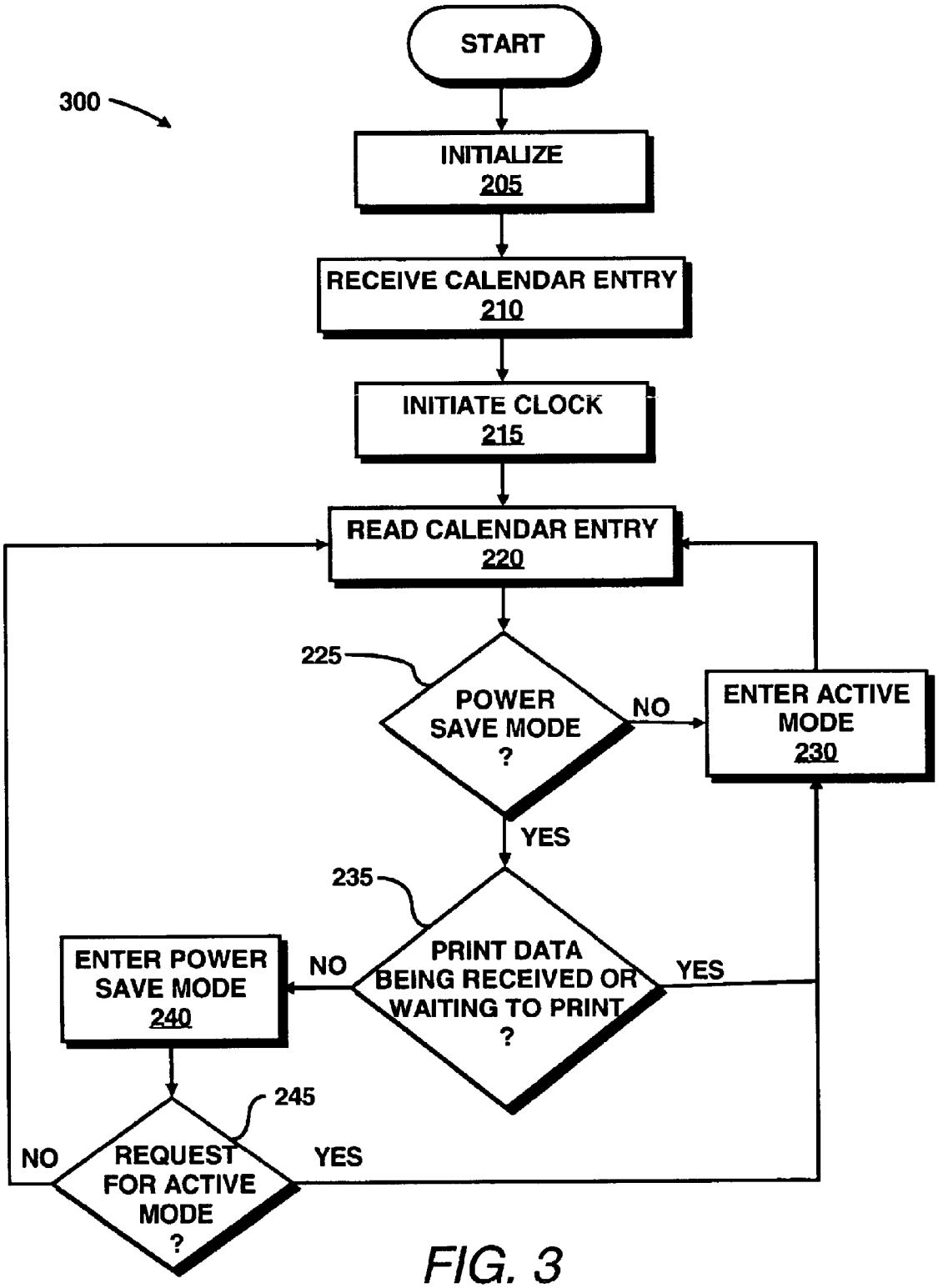
FIG. 3 shows an exemplary flow diagram illustrating another method in accordance with an embodiment of the present invention.

FIG. 3 shows an exemplary flow diagram illustrating a method 300 in accordance with another embodiment of the present invention. The method 300 contains the steps illustrated in FIG. 2. Therefore, the following description of the FIG. 3 will contain only those differences between the figures.

As illustrated in FIG. 3, following step 240 in which the printer enters into a power save mode, the controller may determine whether a request for active mode has been received at step 245. If the controller has received a request for active mode, the printer may enter an active mode at step 230. Otherwise, if no request has been received, the printer may remain in the power save mode as indicated by step 240.

The request for active mode may serve as a manual override to the otherwise automatically operating system for going into and out of the power save mode, or into and out of a plurality of other operational modes. Thus, a user may make a request for active mode through an input device specific to the printer, or the user may make such a request through an external device such the host device for the printer.

It may be appreciated by one skilled in the art that the method described with respect to either of FIG. 2 or 3 is not limited to use of only two operational modes, and that the method may be used to implement a plurality of operational modes. For instance, a printer might operate in a first operational mode during a period that the printer may be expected to produce an image, as indicated by a calendar functionality running within the printer. If, within that period, the printer does not receive an instruction or request to operate, the printer may shift into a second operational mode, simply due to the passage a period of inactivity. This second operational mode would preferably involve a lowered overall power consumption in relation to the first operational mode. If the printer did not then receive an instruction or request to operate, the printer might shift into a third operational mode. This third operational mode would preferably involve a lowered overall power consumption in relation to the second operational mode, such as a hibernation or sleep mode. Thus, it may be appreciated that use of a variety of power modes are contemplated by and included within certain embodiments of the present invention.

The methods 200 and 300 may be performed by a computer program. In one embodiment of the present invention, methods 200 and 300 may be encoded as part of software 40, stored in memory 30 and executed by controller 20. The computer program can exist in a variety of forms, both active and inactive. For example, the computer program may exist as software comprised of program instructions or statements in source code, object code, executable code or other formats; firmware program(s); or hardware description language (HDL) files. Any of the above can be embodied on a computer readable medium, which include storage devices and signals, in compressed or uncompressed form. Exemplary computer readable storage devices include conventional computer system RAM (random access memory), ROM (read only memory), EPROM (erasable, programmable ROM), EEPROM (electrically erasable, programmable ROM), and magnetic or optical disks or tapes. Exemplary computer readable signals, whether modulated using a carrier or not, are signals that a computer system hosting or running the computer program can be configured to access, including signals downloaded through the Internet or other networks. Concrete examples of the foregoing include distribution of executable software program(s) of the computer program on a CD-ROM or via Internet download. In a sense, the Internet itself, as an abstract entity, is a computer readable medium. The same is true of computer networks in general.

While the invention has been described with reference to certain exemplary embodiments thereof, those skilled in the art may make various modifications to the described embodiments of the invention without departing from the scope of the invention. The terms and descriptions used herein are set forth by way of illustration only and not meant as limitations. In particular, although the present invention has been described by examples, a variety of devices would practice the invent concepts described herein. Although the invention has been described and disclosed in various terms and certain embodiments, the scope of the invention is not intended to be, nor should it be deemed to be, limited thereby and such other modifications or embodiments as may be suggested by the teachings herein are particularly reserved, especially as they fall within the breadth and scope of the claims here appended. Those skilled in the art will recognize that these and other variations are possible within the scope of the invention as defined in the following claims and their equivalents.

What is claimed is:

1. A method for power management of a printer, said method comprising:

receiving one or more calendar entries;

determining a power mode for said printer from said one or more calendar entries; and entering a power save mode in response to a determination that said one or more calendar entries indicates that the printer should enter a power save mode;

wherein said step of receiving said one or more calendar entries comprises receiving said calendar entries from a host device.

2. The method according to claim 1, further comprising:

initiating a clock to measure a passage of time from a predetermined event.

3. The method according to claim 2, wherein said clock initiating step comprises at least one of receiving a time stamp from a host device and operating an internal clock.

4. The method according to claim 1, further comprising:

entering an active mode in response to a determination that the one or more calendar entries indicate that the printer should enter an active mode.

5. A method for power management of a printer, said method comprising:

determining a power mode for said printer from one or more calendar entries;

entering a power save mode in response to a determination that the one or more calendar entries indicate that the printer should enter the power save mode;

entering an active mode in response to a determination that the one or more calendar entries indicate that the printer should enter the active mode; and determining at least one of whether print data is being received by said printer and whether the printer is waiting to print prior to said step of entering the active mode.

6. The method according to claim 5, further comprising:

entering the active mode in response to at least one of print data being received and the printer waiting to print.

7. The method according to claim 5, further comprising:

entering the power save mode in response to no print data being received and the printer not waiting to print.

8. The method according to claim 7, further comprising:

determining whether a request for the active mode has been received; and entering the active mode in response to receipt of a request for the active mode being determined.

9. A system for managing power in a printer having at least one component, said system comprising:

a memory configured to store a calendar;

a power supply controller configured to vary an amount of power supplied to said at least one component; and a printer controller configured to access said calendar to determine a power mode for said printer, wherein said printer controller is operable to instruct said power supply controller to vary the amount of cower supplied to said at least one component in response to the power mode determination;

wherein said printer controller is further configured to receive one or more calendar entries from a host device.

10. The system according to claim 9, wherein said host device includes at least one of a computer, personal digital assistant, and server.

11. The system according to claim 9, wherein said printer controller is operable to initiate a clock to measure a passage of time from a predetermined event.

12. The system according to claim 9, wherein said power mode comprises at least one of an active mode and a power save mode.

13. The system according to claim 12, wherein said power save mode comprises a reduction in the amount of energy to operate said at least one component as compared to said active mode.

14. A printing device comprising:

means for storing at least one calendar with one or more entries;

means for analyzing said at least one calendar, wherein said means for analyzing is configured to determine a power mode of said printing device in response to said one or more calendar entries;

means for varying the cower mode of said printing device, wherein said means for analyzing is configured to instruct said means for varying according to said determined power mode; and means for receiving one or more calendar entries from one or more host devices.

15. The printing device according to claim 14, wherein said means for varying comprises means for varying the power mode at least between an active mode and a power save mode.

16. A computer readable storage medium on which is embedded one or more computer programs, said one or more computer programs implementing a method for operating a printer, said one or more computer programs comprising a set of instructions for:

determining a power mode for said printer from one or more calendar entries;

entering a power save mode in response to a determination that the one or more calendar entries indicates that the printer should enter the power save mode;

entering an active mode in response to a determination that the one or more calendar entries does not indicate that the printer should enter the power save mode; and determining at least one of whether print data is being received by said printer and whether the printer is waiting to print prior to said step of entering the active mode.

17. The computer readable storage medium according to claim 16, said one or more computer programs further comprising a set of instructions for:

entering the active mode in response to at least one of print data being received and the printer waiting to print.

18. The computer readable storage medium according to claim 16, said one or more computer programs further comprising a set of instructions for:

entering the power save mode in response to no print data being received and the printer not waiting to print.

19. The computer readable storage medium according to claim 18, said one or more computer programs further comprising a set of instructions for:

determining whether a request for the active mode has been received; and entering the active mode in response to receipt of a request for the active mode being determined.

20. A method for power management of a printer, said method comprising:

receiving one or more calendar entries from host devices of a plurality of users; and selecting a power mode for said printer from among a power save mode and an active mode based on the one or more calendar entries.

21. The method according to claim 20, further comprising:

initiating a clock to measure a passage of time from a predetermined event.

22. The method according to claim 21, wherein said clock initiating step comprises at least one of receiving a time stamp from a host device and operating an internal clock.

23. The method according to claim 20, further comprising:

entering said active mode.

24. A method for power management of a printer, said method comprising:

receiving one or more calendar entries from a plurality of users;

entering a power mode for said printer from among a power save mode and an active mode based on the one or more calendar entries;

entering said power save mode;

entering said active mode in response to a selection of said active mode; and determining at least one of whether print data is being received by said printer and whether the printer is waiting to print prior to said step of entering the active mode.

25. A method for power management of a printer, said method comprising:

receiving one or more calendar entries from a plurality of users;

entering a power mode for said printer from among a power save mode and an active mode based on the one or more calendar entries;

entering said power save mode;

entering said active mode in response to a selection of said active mode; and entering the active mode in response to at least one of print data being received and the printer waiting to print.

26. A method for power management of a printer, said method comprising:

receiving one or more calendar entries from a plurality of users;

entering a power mode for said printer from among a power save mode and an active mode based on the one or more calendar entries;

entering said power save mode;

entering said active mode in response to a selection of said active mode; and entering the power save mode in response to no print data being received and the printer not waiting to print.

27. The method according to claim 26, further comprising:

determining whether a request for the active mode has been received; and entering the active mode in response to receipt of a request for the active mode being determined.

* * * * *

UNITED STATES PATENT AND TRADEMARK OFFICE

CERTIFICATE OF CORRECTION

PATENT NO. : 6,801,730 B2
DATED : October 5, 2004
INVENTOR(S) : Warren Paul Johnson et al.

It is certified that error appears in the above-identified patent and that said Letters Patent is hereby corrected as shown below:

Column 7,
Line 11, after "such" insert -- as --
Line 23, after "passage" insert -- of --

Column 9,
Lines 4 and 29, delete "cower" and insert therefor -- power --

Signed and Sealed this

Nineteenth Day of July, 2005

JON W. DUDAS
*Director of the United States Patent and Trademark Office*